US006985687B2

(12) United States Patent
Mochimaru et al.

(10) Patent No.: US 6,985,687 B2
(45) Date of Patent: Jan. 10, 2006

(54) IMAGE FORMING APPARATUS AND IMAGE FORMING SYSTEM INCLUDING THE SAME

(75) Inventors: Hideaki Mochimaru, Kanagawa (JP); Yasukuni Omata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 10/161,742

(22) Filed: Jun. 5, 2002

(65) Prior Publication Data

US 2003/0007812 A1 Jan. 9, 2003

(30) Foreign Application Priority Data

Jun. 5, 2001 (JP) ..... 2001-170198
May 13, 2002 (JP) ..... 2002-137552

(51) Int. Cl.
*G03G 15/16* (2006.01)
*G03G 15/01* (2006.01)

(52) U.S. Cl. ..... 399/309; 399/101; 399/302

(58) Field of Classification Search ..... 399/101, 399/298, 299, 302, 306, 308, 309, 384, 391, 399/392, 393, 394

See application file for complete search history.

(56) References Cited

U.S. PATENT DOCUMENTS

| | | | | |
|---|---|---|---|---|
| 3,724,944 A | | 4/1973 | Sugita et al. | |
| 3,765,760 A | | 10/1973 | Mochimaru | |
| 3,884,576 A | | 5/1975 | Mochimaru et al. | |
| 3,901,586 A | | 8/1975 | Suzuki et al. | |
| 4,056,320 A | | 11/1977 | Mochimaru et al. | |
| 4,105,326 A | | 8/1978 | Mochimaru | |
| 4,535,982 A | | 8/1985 | Mochimaru | |
| 4,605,299 A | | 8/1986 | Mochimaru | |
| 4,703,334 A | | 10/1987 | Mochimaru et al. | |
| 4,753,543 A | | 6/1988 | Mochimaru et al. | |
| 4,757,344 A | | 7/1988 | Idenawa et al. | |
| 4,875,063 A | | 10/1989 | Idenawa et al. | |
| 4,935,788 A | * | 6/1990 | Fantuzzo et al. | 399/299 |
| 4,987,446 A | | 1/1991 | Mochimaru et al. | |
| 5,089,855 A | | 2/1992 | Mochimaru | |
| 5,138,389 A | * | 8/1992 | Randall | 399/302 |
| 5,394,231 A | | 2/1995 | Sudo et al. | |
| 5,499,078 A | | 3/1996 | Kurokawa et al. | |
| 5,559,590 A | | 9/1996 | Arai et al. | |

(Continued)

FOREIGN PATENT DOCUMENTS

| | | |
|---|---|---|
| JP | 61-289420 | 12/1986 |
| JP | 8-97962 | 4/1996 |
| JP | 10-39550 | 2/1998 |
| JP | 11-24330 | 1/1999 |
| JP | 11-202565 | 7/1999 |
| JP | 11-295937 | 10/1999 |
| JP | 2000-250272 | 9/2000 |

*Primary Examiner*—Sandra L. Brase
(74) *Attorney, Agent, or Firm*—Oblon, Spivak, McClelland, Maier & Neustadt, P.C.

(57) ABSTRACT

An image transferring device of the present invention includes a first and a second intermediate image transfer body whose surfaces endlessly move while forming a nip in contact with ech other. When a sheet nipped by the nip is being conveyed toward a side downstream of the nip in the direction in which the above surfaces move, a first toner image transferred from an image carrier to the second intermediate image transfer body via the first intermediate image transfer body beforehand is transferred to one side of the sheet. At the same time, a second toner image transferred from the image carrier to the first image transfer body beforehand is transferred to the other side of the sheet. One of the two intermediate image transfer bodies is less deformable than the other intermediate image transfer body in the direction of thickness.

71 Claims, 9 Drawing Sheets

U.S. PATENT DOCUMENTS 5,570,162 A 10/1996 Sohmiya
5,594,540 A 1/1997 Higaya et al.
5,615,872 A 4/1997 Mochimaru
5,619,311 A 4/1997 Kurokawa et al.
5,678,152 A 10/1997 Kohno et al.
5,765,092 A * 6/1998 Yoshiuchi et al. ..... 399/394
5,832,354 A 11/1998 Kouno et al.
5,915,147 A 6/1999 Kouno et al.
5,930,572 A * 7/1999 Haneda et al. ..... 399/309
5,970,277 A * 10/1999 Shigeta et al. ..... 399/306 X
6,088,565 A * 7/2000 Jia et al. ..... 399/302
6,091,928 A * 7/2000 Fuchisawa ..... 399/384
6,097,921 A * 8/2000 Kageyama ..... 399/306
6,151,057 A 11/2000 Yamazaki et al.
6,173,148 B1 1/2001 Matsuda et al.
6,259,880 B1 * 7/2001 Jia et al. ..... 399/307
6,347,214 B1 2/2002 Kaneko

* cited by examiner

IMAGE FORMING APPARATUS AND IMAGE FORMING SYSTEM INCLUDING THE SAME

BACKGROUND OF THE INVENTION

1. Field of the Invention

The present invention relates to an image forming apparatus of the type capable of forming images on both sides of a sheet or recording medium, and an image forming system including the same.

2. Description of the Background Art

An image forming apparatus of the type described is implemented as, e.g., an electronic copier, a printer, a facsimile apparatus or a multifunction machine having at least two of such functions. This type of apparatus is generally constructed to transfer a first image from an image carrier to one side of a sheet, fix the image on the sheet, reverse the sheet to thereby again deliver it to the image carrier, transfer a second image from the image carrier to the other side of the sheet, and then fix the second image to thereby produce a duplex print. However, the problem with this type of apparatus is that two times of delivery of a single sheet to the image carrier increases the overall image forming time and thereby lowers productivity.

In light of the above, Japanese Patent Laid-Open Publication No. 11-295937, for example, discloses an image forming apparatus including an intermediate image transfer belt and a first and a second image carrier. An image formed on the first image carrier is transferred to the intermediate image transfer belt while an image formed on the second image carrier is directly transferred to one side of a sheet. The image transferred to the intermediate image transfer belt is transferred to the other side of the same sheet. This successfully reduces image forming time in a duplex print mode for thereby enhancing productivity.

In the image forming apparatus disclosed in the above document, the intermediate image transfer belt is elongate in the up-and-down direction, preventing the apparatus from increasing in size in the horizontal direction. However, a sheet feeder loaded with a stack of sheets is positioned below the intermediate image transfer belt. This brings about a problem that when a plurality of sheet feeders are arranged one above the other, the overall height of the apparatus noticeably increases, making it difficult for the user to operate the apparatus. Moreover, such a height of the apparatus makes the apparatus unstable when installed at the user's station. This problem becomes more serious when a plurality of first image carriers and a plurality of second image carriers are arranged at both sides of the intermediate image transfer belt.

Technologies relating to the present invention are also disclosed in, e.g., Japanese Patent Laid-Open Publication Nos. 8-97962, 10-39550, 11-24330, 11-202565 and 11-295937.

SUMMARY OF THE INVENTION

It is an object of the present invention to provide an image forming apparatus free from the problem described above, and an image forming system including the same.

An image forming apparatus of the present invention includes at least one first image carrier on which an image is to be formed, an endless, intermediate image transfer belt to which the image is to be transferred from the first image carrier, and at least one second image carrier on which an image is to be formed. The image formed on the second image carrier is transferred to the first side of a recording medium while the image transferred to the intermediate image transfer belt is transferred to the second side of the recording medium. The intermediate image transfer belt is elongate in the up-and-down direction. A plurality of medium feeders are arranged one above the other at one side of the intermediate image transfer belt, and each is loaded with a stack of recording media to be fed toward an image transfer position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
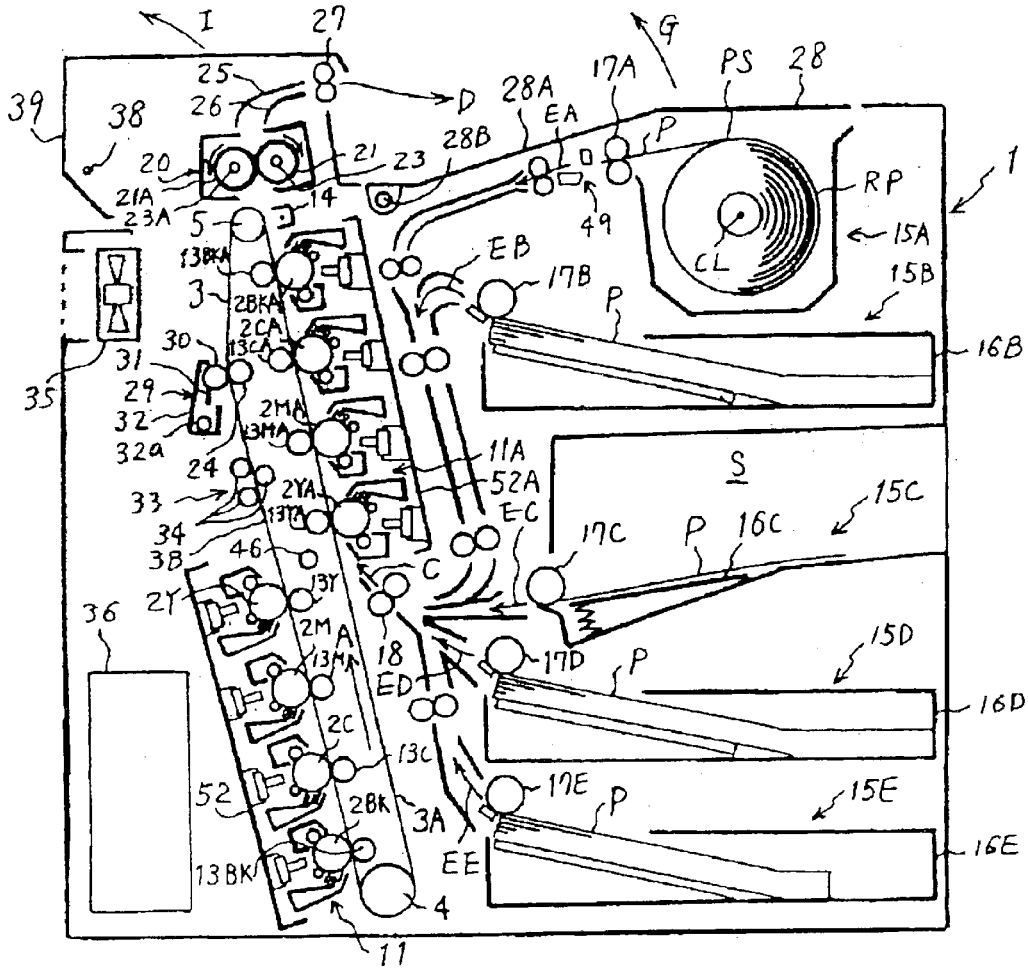
FIG. 1 is a section showing an image forming apparatus embodying the present invention.

Referring to FIG. 1 of the drawings, an image forming apparatus embodying the present invention is shown and implemented as a printer capable of forming color images or a combined printer/facsimile apparatus by way of example. As shown, the image forming apparatus includes a casing 1 accommodating a group of first image carriers 2Y (yellow), 2M (magenta), 2C (cyan) and 2 BK (black) and a group of second image carriers 2YA, 2MA, 2CA and 2BKA. In the illustrative embodiment, the image carriers 2Y through 2BK and 2YA through 2BKA are implemented as photoconductive drums and will be referred to as drums in this sense hereinafter. An endless, intermediate image transfer belt (simply belt hereinafter) 3 is passed over a plurality of support members including rollers 4 and 5 and a back roller 24, which will be described specifically later. The belt 3 runs in a direction indicated by an arrow A in FIG. 1.

The first drums 2Y through 2BK and second drums 2YA through 2BKA each are arranged side by side in the direction of movement of the belt 3 and held in contact with the outer periphery of the belt 3. The belt 3 is positioned between the drums 2Y through 2BK and the drums 2YA through 2BKA.

Figure 2:
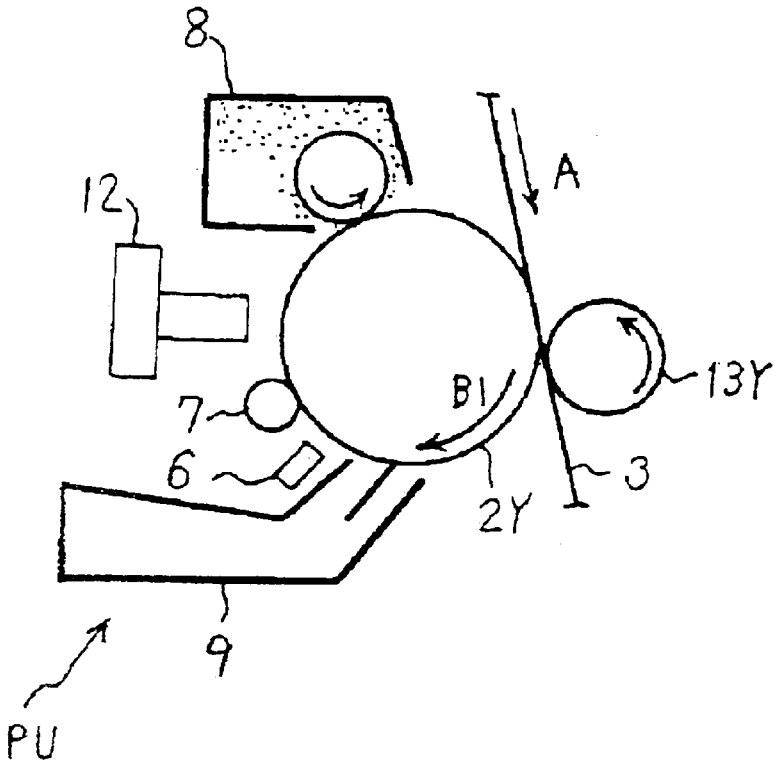
FIG. 2 is an enlarged view showing a first image carrier included in the illustrative embodiment together with process units arranged therearound.

FIG. 2 shows the first drum 2Y and arrangements around it. As shown, a discharger 6, a charger 7, an optical writing unit 12, a developing unit 8 and a cleaning unit 9 are arranged around the drum 2Y and cooperate to form a yellow toner image on the drum 2Y, as will be described in detail later. Such process units are arranged around each of the other first drums 2M, 2C and 2BK also. The difference is that a magenta toner image, a cyan toner image and a black toner image are formed on the drums 2M, 2C and 2BK, respectively.

Figure 3:
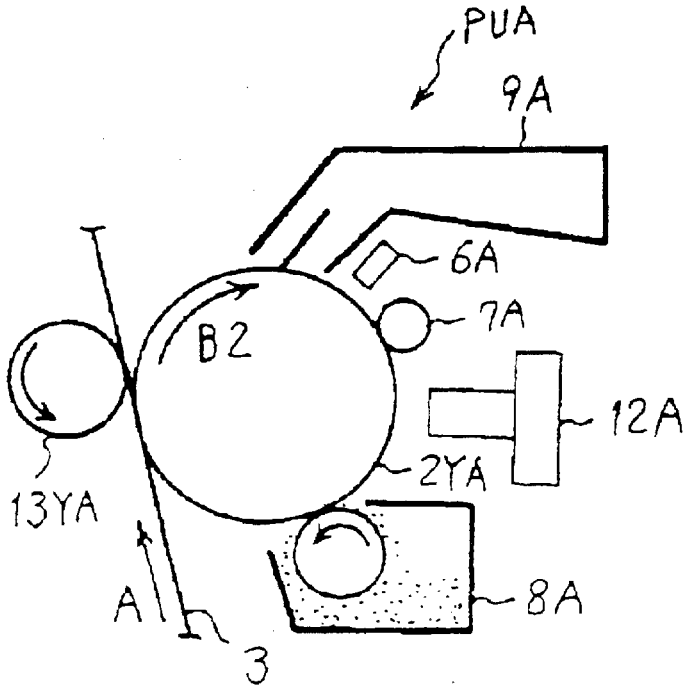
FIG. 3 is an enlarged view showing a second image carrier included in the illustrative embodiment together with process units arranged therearound.

A yellow toner image, a magenta toner image, a cyan toner image and a black toner image are also formed on the second drums 2YA, 2MA, 2CA and 2BKA, respectively. FIG. 3 shows the second drum 2YA by way of example together with arrangements around the drum 2YA. As shown, a discharger 6A, a charger 7A, an optical writing unit 12A, a developing unit 8A and a cleaning unit 9A are arranged around the drum 2YA and cooperate to form the yellow toner image. This is also true with arrangements around the other drums 2MA, 2CA and 2BKA except for the color of the toner image.

While the belt 3 runs in the direction A during image formation, the first drums 2Y through 2BK and second drums 2YA through 2BKA respectively rotate in directions indicated by arrows B1 and B2 in FIGS. 2 and 3, respectively. In this condition, toner images of different colors are formed on the drums, as will be described hereinafter.

Referring again to FIG. 2, the charger 7 uniformly charges the surface of the first drum 2Y to preselected polarity, which is negative polarity in the illustrative embodiment. The optical writing unit 12 scans the charged surface of the drum 2Y with a light beam in accordance with image data, thereby forming a latent image on the drum 2Y. More specifically, the latent image is formed in a portion scanned by the light beam and lowered in surface potential thereby in terms of absolute value. The developing device 8 develops the latent image with yellow toner to thereby produce a yellow toner image. More specifically, the toner stored in the developing device 8 is charged to preselected polarity, i.e., negative polarity like the drum 2Y beforehand and electrostatically deposited on the latent image to thereby develop the latent image. While the illustrative embodiment effects reversal development, as stated above, it may be configured to effect regular development. A magenta toner image, a cyan toner image and a black toner image are respectively formed on the drums 2M, 2C and 2BK in exactly the same manner as the yellow toner image.

A first image transferring device 13Y is positioned at the back of the belt 3 and applied with a positive voltage for image transfer, which is opposite in polarity to the toner deposited on the drum 2Y. The image transferring device 13Y electrostatically transfers the yellow toner image from the drum 2Y to the outer periphery of the belt 3, which is moving in synchronism with the drum 2Y. After the image transfer, the cleaning unit 9 removes the toner left on the drum 2Y. Subsequently, the discharger 6 discharges the cleaned surface of the drum 2Y with light to thereby prepare the drum 2Y for the next image forming cycle.

Likewise, first image transferring devices 13Y, 13C and 13BK respectively transfer the magenta toner image, cyan toner image and black toner image from the drums 2M, 2C and 2BK to the belt 3 over the yellow toner image, completing a full-color image on the belt 3. The procedure to follow the image transfer is identical with the procedure described in relation to the yellow toner image. The belt 3 carrying the full-color image thereon continuously moves in the direction A.

A yellow toner image, a magenta toner image, a cyan toner image and a black toner image are respectively formed on the second drums 2YA, 2MA, 2CA and 2BKA in exactly the same manner as the images formed on the first drums 2Y through 2BK. More specifically, when the full-color image carried on the belt 3 arrives at a preselected position, the yellow toner image begins to be formed on the drum 2YA. Subsequently, the magenta toner image, cyan toner image and black toner image are sequentially formed on the drums 2MA, 2CA and 2BKA, respectively, over the yellow toner image. Toners forming the images on the drums 2YA through 2BKA are charged to the same polarity as the toners deposited on the drums 2Y through 2BK, i.e., negative polarity.

Sheet feeders or medium feeders 15A, 15B, 15C and 15E are positioned at one side of the belt 3, and each is loaded with a stack of paper sheets, resin sheets or similar recording media P, as will be described in detail later. The sheet P paid out from any one of the sheet feeders 15A through 15E is conveyed to a registration roller pair 18, which is a specific form of a registering device. The registration roller pair 18 conveys the sheet P at preselected timing toward consecutive nips between the belt 3 and the second drums 2YA through 2BKA, as indicated by an arrow C in FIG. 1. The sheet P is then conveyed by the belt 3.

Second image transferring devices 13YA, 13MA, 13CA and 13BKA are positioned at the back of the belt 3 in such a manner as to substantially face the drums 2YA, 3MA, 2CA and 2BKA, respectively. A voltage for image transfer opposite in polarity to the images formed on the drums 2YA through 2BKA, i.e., a positive voltage is applied to each of the image transferring devices 13YA through 13BKA. In this condition, the yellow toner image, magenta toner image, cyan toner image and black toner image are sequentially, electrostatically transferred from the drum 2YA through 2BKA to one side of the sheet P one above the other. As a result, a full-color image is formed on the sheet P. At the same time, the full-color image transferred from the first drums 2Y through 2BK to the belt 3 moves through the nips between the second drums 2YA through 2BKA and the belt 3.

A third image transferring device 14 is positioned downstream of the second drums 2YA through 2BKA in the direction of movement of the belt 3 and faces, but does not contact, the belt 3. The image transferring device 14 is implemented as a corona discharger. A voltage for image transfer opposite in polarity to the images transferred from the first drums to the belt 3, i.e., a positive voltage is also applied to the charge wire of the image transferring device 14. As a result, the full-color image carried on the belt 3 is transferred to the other side of the sheet P facing the outer periphery of the belt 3.

The full-color image transferred from the first drums 2Y through 2BK to the other side of the sheet P by way of the belt 3 will sometimes be referred to as a first full-color image. The other full-color image directly transferred from the second drums 2YA through 2BKA to one side of the sheet will sometimes be referred to as a second full-color image. The timing at which the images begin to be formed on the second drums 2YA through 2BKA and the timing at which the sheet P begins to be paid out are controlled such that the first and second full-color images are accurately transferred to the opposite sides of the sheet P.

A fixing device 20 is positioned above the belt 3 and made up of a pair of rollers 21 and 21A and a pair of heaters 23 and 23A respectively disposed in the rollers 21 and 21A. The rollers 21 and 21A are rotatable in directions indicated by arrows in FIG. 1 in pressing contact with each other. The heaters 23 and 23A respectively heat the rollers 21 and 21A to fixing temperature adequate for the fixation of the full-color images. The sheet P carrying the first and second full-color images on both sides thereof and left the belt 3 is passed through the nip between the rollers 21 and 21A. The rollers 21 and 21A respectively fix the first and second full-color images on the sheet P with heat and pressure. The sheet P with the fixed full-color images, i.e., a print is driven out to a print tray 28 by an outlet roller pair 27 while being guided by guides 25 and 26. The print tray 28 is positioned on the top of the casing 1.

A belt cleaning unit 29 removes the toner left on the belt 3 after the image transfer described above. The belt cleaning unit 29 includes a cleaning roller 30, a blade 31, a case 32, and a conveyor 32*a*. The cleaning roller 30 removes the toner left on the belt 3 after image transfer while the blade 31 removes the toner collected by the cleaning roller 30. The cleaning roller 30 and blade 31 are supported by the case 32. The conveyor 32*a* conveys the collected toner to a toner storing section not shown. The back roller 24 mentioned earlier faces the cleaning roller 30 with the intermediary of the belt 3.

A cooling device 33 cools off part of the belt 3 moved away from the belt cleaning unit 29. The cooling device 33 may be implemented as a blower for blowing atmospheric air or similar cool air against the belt 3 or a radiating member. In the illustrative embodiment, the cooling device 33 is implemented as a plurality of heat pipes 34 held in contact with the opposite surfaces of the belt 3 for absorbing heat. In this manner, the cooling device 33 lowers the temperature of the belt 3 heated by the fixing unit 20 and may be applied to any type of apparatus. This prevents the first drums 2Y through 2BK form being excessively heated by the belt 3 and thereby prevents the full-color image from being deteriorated. However, the cooling device 33 is not essential with the illustrative embodiment.

A fan 35 discharges air inside the casing 1 to the outside to thereby prevent temperature inside of the casing 1 from rising to an excessive degree. In FIG. 1, the reference numeral 1 designates a control unit.

The belt 3 is heat-resistant and provided with resistance that allows toner to be transferred thereto. For example, the belt 3 is made up of a heat-resistant base and a surface layer formed on the belt 3 and having low surface energy. The volume resistivity of the entire belt 3 is, e.g., $10^6$ Ω·cm to $10^{12}$ Ω·cm. More specifically, the base may be formed of polyimide or polyamideimide and 50 μm to 200 μm thick. The surface layer may be implemented as a coating layer having low surface energy and formed of Teflon or similar fluorocarbon resin. The surface of the belt 3 should preferably have resistivity of $10^5$ Ω·cm to $10^{12}$ Ω·cm.

As the image forming cycle stated earlier is repeated, a number of prints are stacked on the print tray 28. In the illustrative embodiment, each print is driven out to the print tray 28 with the side thereof to which the second full-color image is transferred from the second drums 2YA through 2BKA facing downward. Therefore, to stack the prints in order of page, a second page is transferred from the first drums 2Y through 2BK to the other side of a sheet P by way of the belt 3 while a first page is directly transferred from the drums 2YA through 2BKA to one side of the same sheet P. Likewise, a fourth page is transferred from the first drums 2Y through 2BK to the other side of the next sheet P by way of the belt 3 while a third page is directly transferred from the second drums 2YA through 2BKA to one side of the same sheet. Such a procedure allows the prints to be sequentially stacked on the print tray 28 in order of page.

The first images formed on the first drums 2Y through 2BK are inverted to become mirror images when transferred to the belt 3, and again inverted to become a non-inverted full-color image when transferred to the other side of a sheet P. The second images formed on the second drums 2YA through 2BKA are inverted images, but become a non-inverted full-color image when transferred to one side of the sheet P.

To form images with the first drums 2Y through 2BK and second drums 2YA through 2BKA in order of page, the illustrative embodiment can use a conventional method that stores image data in a memory. In addition, the illustrative embodiment can use any conventional image processing technology for forming non-inverted images and inverted images on the drums 2Y through 2BK and drums 2YA through 2BKA, respectively.

In the illustrative embodiment, the first image transferring devices 13Y through 13BK and second image transferring devices 13YA through 13BKA are implemented as rollers rotatable in contact with the inner periphery of the belt 3. Alternatively, use may be made of image transferring devices using brushes, blades or brush rollers rotatable with the inner periphery of the belt 3 with a voltage being applied thereto. Further, use may be made of image transferring devices implemented as corona dischargers spaced from the inner periphery of the belt 3.

An arrangement may be made such that before the first full-color image transferred from the first drums 2A through 2BK to the belt 3 reaches the second drum 2YA, a corona discharger or similar polarity inverting device inverts the polarity of the first full-color image to polarity opposite to that of the second full-color image, i.e., positive polarity. In this case, if a positive voltage is applied to each of the second image transferring devices 13YA through 13BKA, then the first and second full-color images can be transferred to opposite sides of a sheet P at the same time. This makes the third image transferring device 14 unnecessary.

While the illustrative embodiment includes a plurality of first drums 2Y through 2BK and a plurality of second drums 2YA through 2BKA, it is, of course, practicable with at least one first drum and at least one second drum.

Another alternative arrangement available with the illustrative embodiment is as follows. A first image carrier and a second image carrier are used as intermediate image transfer bodies. Toner images of different colors are sequentially formed on a photoconductive element, not shown, and sequentially transferred to the first image carrier one above the other to thereby form a first full-color image. Likewise, toner images of different colors are sequentially formed on another photoconductive element, not shown, and sequentially transferred to the second image carrier one above the other to thereby form a second full-color image. The first second full-color image is directly transferred to one side of a sheet while the first full-color image is transferred to the other side of the same sheet by way of an intermediate image transfer belt. The sheet with such full-color toner images is fixed and then driven out as a print.

It will be seen from the above that the illustrative embodiment is practicable with at least one first image carrier, an endless, intermediate image transfer belt to which an image is transferred from the first image carrier, and at least one second image carrier on which an image different from the above image is formed. The image on the second image carrier is transferred to one side of a sheet while the image transferred to the belt is transferred to the other side of the sheet. In this configuration, only if a single sheet P is conveyed to a nip between the belt 3 and the second image carrier, images can be formed on both sides of the sheet P. This successfully reduces image forming time and enhances the productivity of duplex prints.

Simplex prints each carrying an image on one side thereof are also achievable with the illustrative embodiment. In this case, no images are formed on the first drums 2Y through 2BK while images are formed on the second drums 2YA through 2BKA in exactly the same manner as stated earlier. Although no voltages are applied to the first drums 13Y through 13BKA, the drums 13Y through 13BKA each are rotated in the direction B1 while the belt 3 is moved in the direction A.

More specifically, in a simplex print mode, while the belt 3 conveys a sheet P fed from the registration roller pair 18, the second image transferring devices 13YA through 13BKA sequentially transfer images formed on the drums 2YA through 2BKA to one side of the sheet P one above the other, thereby completing a full-color image. The full-color image is fixed on the sheet P by the fixing device 20. Thereafter, the sheet or print P is driven out to the print tray 28 by the outlet roller pair 27 face down while being guided by the guides 25 and 26, as stated earlier. It follows that consecutive prints are sequentially stacked on the print tray 28 in order of page.

Alternatively, in the simplex print mode, images may be formed on the first drums 2Y through 2BK instead of the second drums 2YA through 2BKA, transferred to the belt 3 one above the other to form a full-color image, fixed, and then driven out to the print tray 28.

Figure 4:
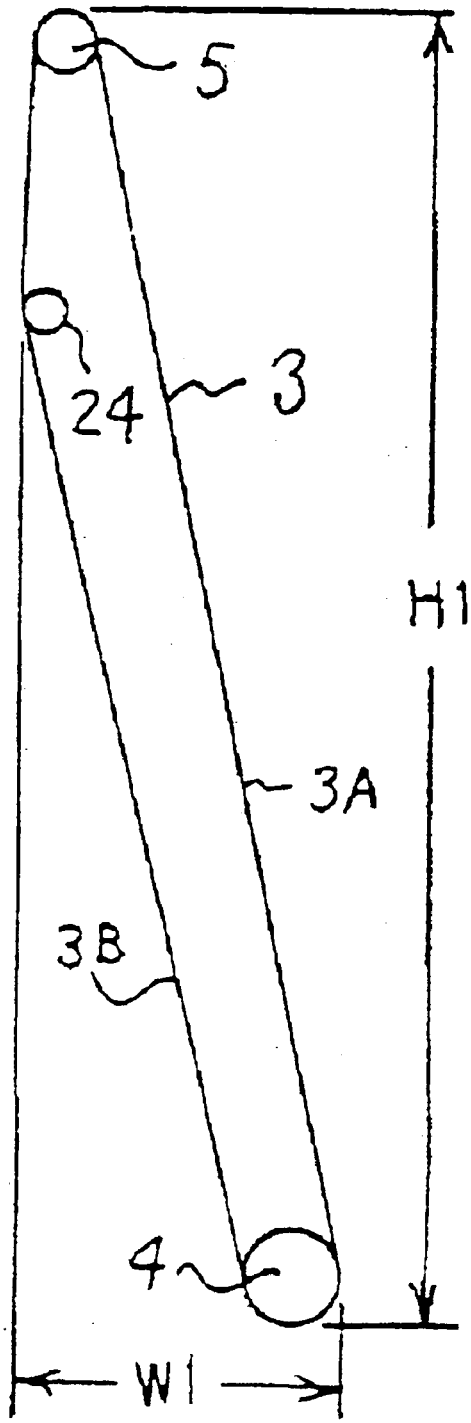
FIG. 4 shows a position of an intermediate image transfer belt included in the illustrative embodiment.

As shown in FIG. 1, the belt 3 is elongate in the up-and-down direction. More specifically, as shown in FIG. 4, the belt 3 is passed over a plurality of support members 5 and 4 such that its height H1 in the vertical direction is greater than its width W1 in the horizontal direction. The belt 3 has one surface 3A and the other surface 3B extending in the up-and-down direction each. The plurality of sheet feeders 15A through 15E, FIG. 1, mentioned earlier are arranged one above the other along one surface 3A of the belt 3.

The belt 3 extending in the up-and-down direction reduces the overall width of the image forming apparatus in the horizontal direction and makes the entire construction compact. Further, the sheet feeders 15A through 15E arranged one above the other at one side of the belt 3 prevent the overall height of the apparatus from increasing to a noticeable degree. The apparatus is therefore easy to operate and is stable when installed at the user's station. By contrast, assume that a plurality of sheet feeders are arranged below an intermediate image transfer belt extending in the up-and-down direction as conventional. Then, although the overall width of this kind of apparatus in the horizontal direction decreases, the overall height of the apparatus noticeably increases and makes the apparatus uneasy to operate and unstable.

A specific configuration of the sheet feeders 15A through 15E will be described hereinafter. It is to be noted that the number and configuration of the sheet feeders are open to choice. As shown in FIG. 1, the second sheet feeder 15B from the top, the bottom sheet feeder 15E and the second sheet feeder 15D from the bottom include cassettes 16B, 16E and 16D and pickup rollers 17B, 17E and 17D, respectively. The cassettes 16B, 16E and 16D each are loaded with sheets P of preselected size. The pickup rollers 17B, 17E and 17D rotate clockwise, as viewed in FIG. 1, in contact with the top sheets P of the associated cassettes 16B, 16E and 16D, thereby paying them out in directions EB, EE and ED, respectively. The cassettes 16B, 16E and 16D can be pulled out of the housing 1 in a direction F (see FIG. 5) for the replenishment of sheets or the replacement of the sheets with another kind of sheets.

The sheet feeder 15C is implemented as a manual sheet feeder for allowing the operator of the apparatus to insert an envelope, thick card, sheet of irregular size or similar special recording medium by hand. The manual sheet feeder 15C includes a tray 16C and a pickup roller 17C for paying out a sheet P laid on the tray 16C. More specifically, the pickup roller 17C rotates clockwise, as viewed in FIG. 1, to thereby pay out the sheet P in a direction EC. The sheet feeder 15C is arranged in a space S formed in the intermediate portion of the casing 1 in the vertical direction. The space S is so dimensioned as to accommodate most sheets although some sheets may be long and protrude from the space S.

The top sheet feeder 15A is loaded with a roll of elongate recording medium RP, e.g., an elongate webbing of resin or paper. In this sense, the top sheet feeder 15A will be referred to as a roll feeder hereinafter. The edge of the webbing paid out from the roll RP is nipped by a pullout roller pair 17A. When the pullout roller pair 17A is rotated, it conveys the webbing in a direction EA. A cutter 49 cuts the webbing at a preselected length.

The sheet P fed from any one of the sheet feeders 15A through 15E is conveyed to the registration roller pair 18 and then conveyed by the registration roller pair 18 at preselected timing toward the image transfer position stated previously. In this manner, various kinds of recording media can be selectively delivered to the image transfer position.

As shown in FIG. 1, the belt 3 is slightly inclined from the vertical direction in order to slightly reduce the overall height of the apparatus. The first drums 2Y through 2BK and second drums 2YA through 2BKA are positioned at both sides of the belt 3 in the horizontal direction. This, coupled with the fact that the second drums are positioned between the belt 3 and the sheet feeders 15A through 15E, makes the entire construction compact and enhances stability while surely balancing the height and width of the apparatus. To further reduce the overall width of the first and second drums and belt 3 in the horizontal direction, the belt 3 may be inclined such that its top is remoter from the sheet feeders, and the first drums may be positioned at a lower level than the second drums.

If desired, two roll feeders may be substituted for the single roll feeder 15A shown in FIG. 1. The crux is that at least one of the plurality of sheet feeders be implemented as a roll feeder. This is also true with the roll feeder 15A.

In the illustrative embodiment, images can be formed on both sides of a sheet cut away from the webbing, which is paid out from the roll RP, only if the sheet is conveyed once. Therefore, images can be formed on both sides of a sheet having substantially any desired length. By contrast, in a conventional image forming apparatus of the type forming images on both sides of a sheet by feeding it to an image transfer position two times, the length of the sheet is limited.

As shown in FIG. 1, a position PS where the webbing is paid out from the roll RP is positioned above the center CL of the roll RP, preferably at the top of the roll PP. It is therefore easy for the operator to mount the roll RP to the sheet feeder 15A and set the edge of the webbing between the pullout rollers 17A.

The print tray 28 is positioned above the sheet feeders 15A through 15E that are arranged one above the other. That is, the sheet feeders 15A through 15E and print tray 28 all are aligned with each other in the up-and-down direction, so that the print tray 28 does not protrude from the casing 1 sideways. The casing 1 can therefore be positioned in the vicinity of, e.g., the wall of a room, occupying a minimum of space.

The conveyance paths extending from the sheet feeders 15A through 15E to the print tray 28 are configured such that prints are stacked on the print tray 28 with the image transferred from the second image carrier or carriers facing downward. Therefore, in both of the duplex print mode and simplex copy mode, prints can be stacked on the print tray 28 in order of page. Usually, the simplex print mode is predominant over the duplex copy mode, allowing the operator to perform efficient operation.

As shown in FIG. 1, the print tray 28 is implemented as a cover 28A or part of the cover 28A. The cover 28A is mounted to the casing 1 via a hinge 28B and openable about the hinge 28B away from the casing 1 in a direction G. The operator can therefore open the cover 28A, set the roll RP on the sheet feeder 15A from above, and then cause the pullout roller pair 17A to nip the edge of the webbing paid out from the roll RP. Further, the position PS where the webbing is paid out from the roll RP is positioned above the roll RP and further facilitates the above operation. At this instant, the cutter 49 does not obstruct the operator's work and therefore does not have to be retracted, so that the apparatus is simplified. Should the position PS be positioned below the roll RP, it would be uneasy for the operator to perform such work.

A plurality of manual sheet feeders may be substituted for the single manual sheet feeder 15C, if desired. In the illustrative embodiment, the registration roller pair or registering device 18 is positioned at a lower level than the second drums 2YA through 2BKA. As shown in FIG. 1, the path extending from the manual sheet feeder 15C to the registering device should preferably be linear. Should the above path be curved, it might obstruct the conveyance of an envelope, thick sheet or similar special sheet.

The first image carriers and second image carriers are positioned at different levels, as stated earlier. It is preferable that the second image carriers be positioned above the intermediate point of the belt 3 in the up-and-down direction, and that the registering device be positioned below the second image carriers. As shown in FIG. 1, a support shaft 46, which will be described later, is positioned at the intermediate between the top and the bottom of the belt 3. The second drums 2YA through 2BKA are positioned above the axis of the support shaft 46 while the registration roller pair 18 is positioned in a space beneath the second drums. Such a configuration makes the arrangement of the belt 3 and drums 2YA through 2BKA and therefore the entire construction compact.

The first drums 2Y through 2BK are positioned below the axis of the support shaft 46 while the cleaning device 29 and cooling device 33 are positioned above the drums 2Y through 2BK. In this manner, the first image carriers are positioned below the intermediate between the top and the bottom of the belt 3 while at least one of the cleaning device 29 and cooling device 33 is positioned above the first image carriers. This makes the arrangement of the belt 3, cleaning device 29 and cooling device 33 and therefore the entire construction compact.

Figure 6:
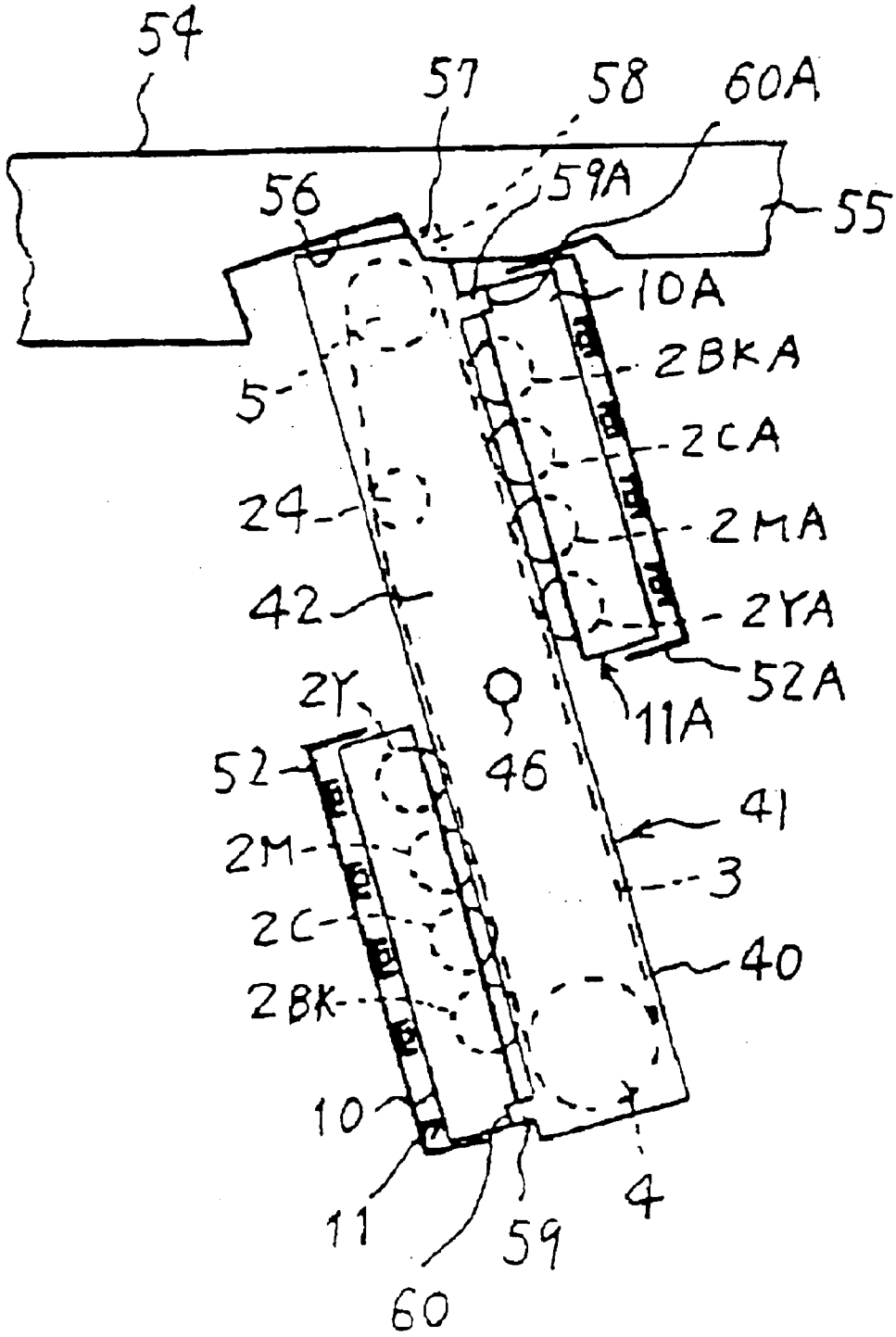
FIG. 6 is a front view showing a first and a second image forming unit included in the illustrative embodiment and appearing when a front door is opened.

As shown in FIG. 2, the first drum or image carrier 2Y, discharger 6, charger 7, developing device 8 and cleaning device 9 are constructed into a single process unit PU. This is also true with the other first drums 2M, 2C and 2BK and process units arranged therearound. As shown in FIG. 6, such process units are mounted on a single unit case 10 to thereby constitute a first image forming unit 11. Likewise, as shown in FIG. 3, the second drum or image carrier 2YA, discharger 6A, charger 7A, developing device 8A and cleaning device 9A are constructed into a single process unit PUA. As shown in FIG. 6, such process units are mounted on a single unit case 10A to thereby constitute a second image forming unit 11A. In such a configuration, the optical writing unit 12 or 12A is separate from the process unit PU or PUA or the image forming unit 11 or 11A.

When the sheet P jams the path during image formation, the apparatus interrupts image formation, causes the first and second image carriers and belt 3 to stop rotating, and urges the operator to remove the jamming sheet P. Further, the image carriers and belt 3, as well as other structural elements, need inspection or repaired from time to time. Moreover, each of such structural elements must be replaced when its service life ends. In the illustrative embodiment, when any one of the process units PU and PUA, first and second image forming units 11 and 11A and belt 3 reaches its life, it can be replaced with new one.

Figure 5:
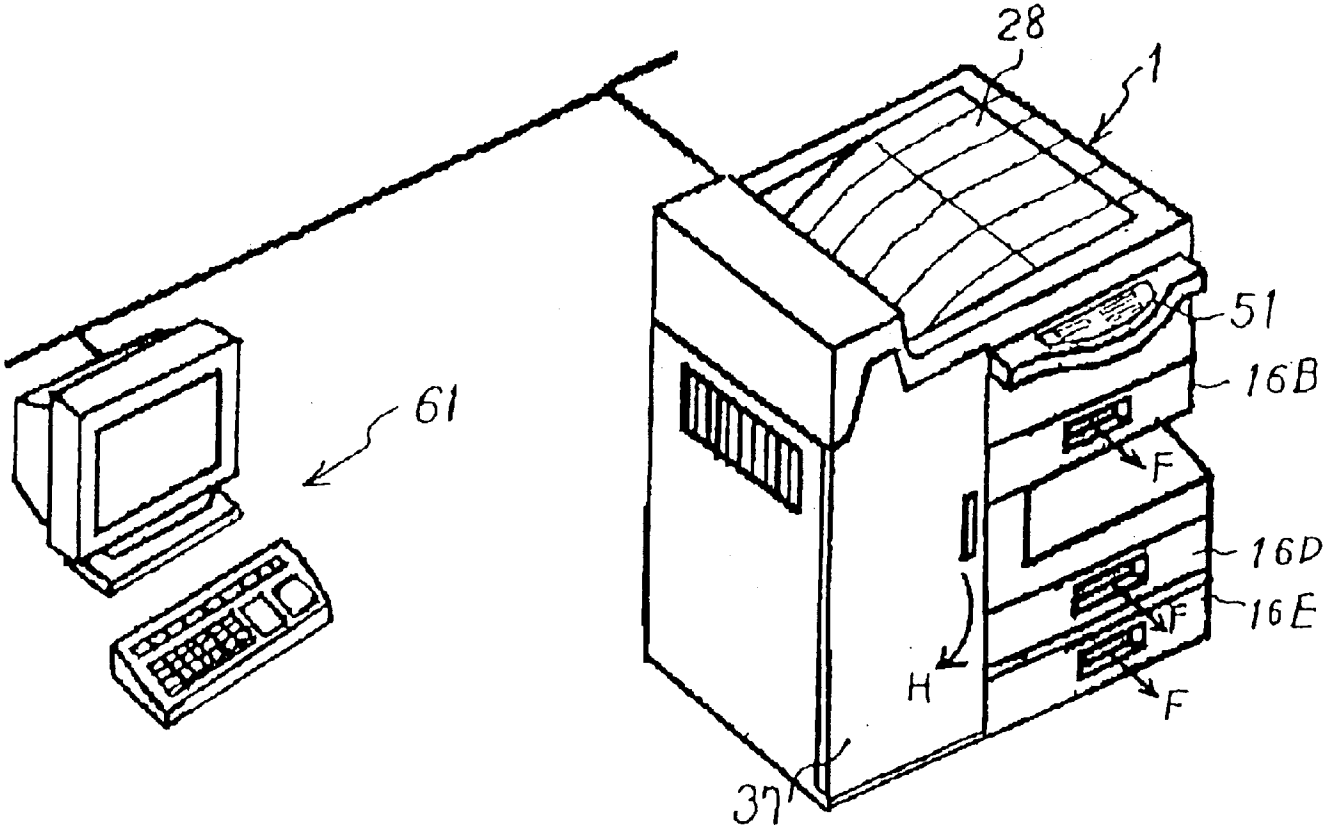
FIG. 5 is an external view showing the image forming apparatus of the illustrative embodiment and a host computer interconnected to each other.

As shown in FIG. 5, for the above various kinds of maintenance work, the casing 1 includes a front door 37 openable in a direction H. Also, as shown in FIG. 1, the upper portion of the casing 1 is implemented as a top door 39 hinged to the casing 1 via a shaft 38. The top door 39 uncovers the upper portion of the casing 1 when opened in a direction I. When either one of the front door 37 and top door 39 is opened during image formation, a switch, not shown, associated therewith is turned off to automatically interrupt image formation.

By opening the top door 39 or the front door 37, the operator can remove a jamming sheet or remove any one of the belt 3 and image forming units 11 and 11A. At this instant, if such maintenance work is performed with the belt 3 and first and second drums remaining in contact with each other, as shown in FIG. 1, then the jamming sheet is likely to hit against the belt 3 or the first and second drums, scratching the surface of the belt 3 or the surfaces of the drums.

Figure 9:
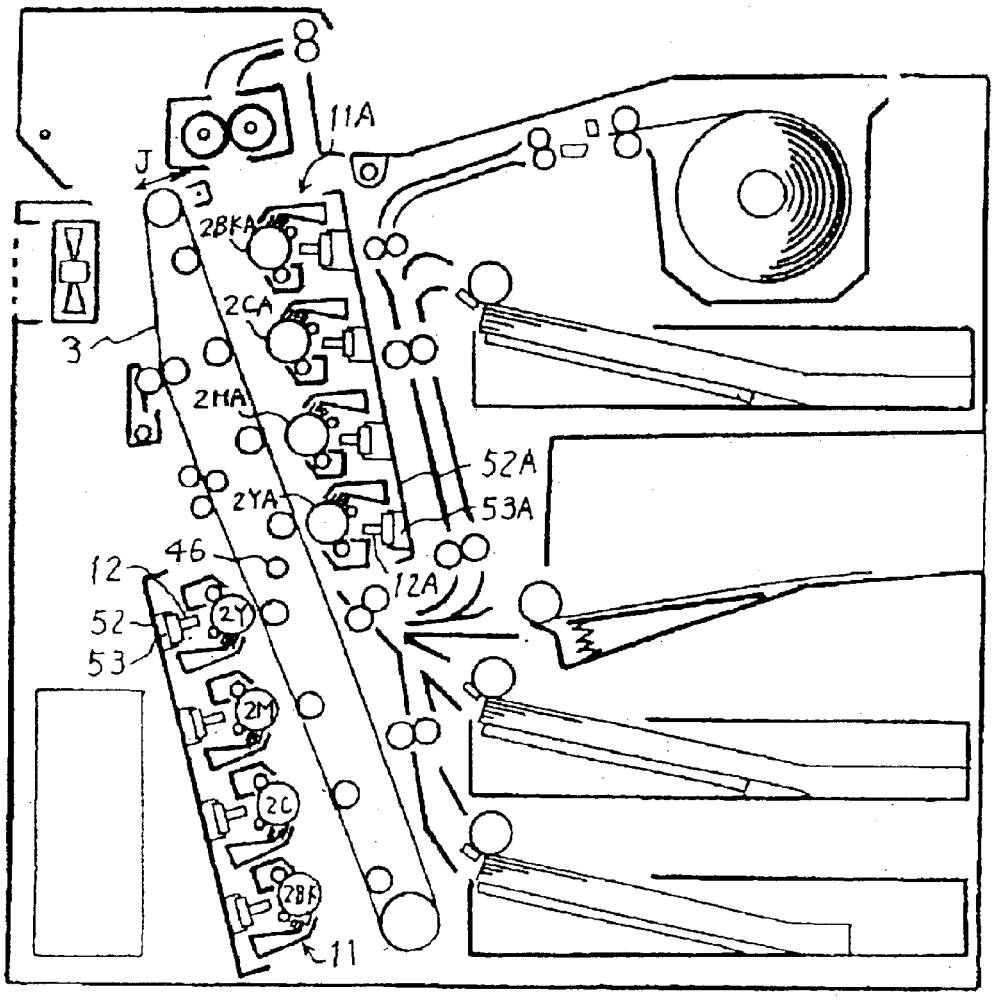
FIG. 9 is a section showing the belt in a position released from the first and second image carriers.

In light of the above, the belt 3 is configured to be movable between a first position shown in FIG. 1 where it contacts the first and second drums and a second position shown in FIG. 9 where the former is spaced from the latter in a direction J. This allows the operator to release the belt 3 from the first and second drums after opening the top door 39 or the front door 37, and then perform the maintenance work without scratching the belt 3 or the drums. After the maintenance work, the operator should only bring the belt 3 into contact with the first and second drums and then close the top door 39 or the front door 37.

As stated above, the belt 3 is moved away from the first and second drums to thereby promote easy, rapid operation, compared to a case where the first and second drums are moved away from the belt 3. Further, moving the belt 3 away from the first and second drums makes the entire construction simpler and the cost lower than moving the latter away from the former. Moreover, the operator should only move the belt 3 by a small angle in the direction J.

Figure 8:
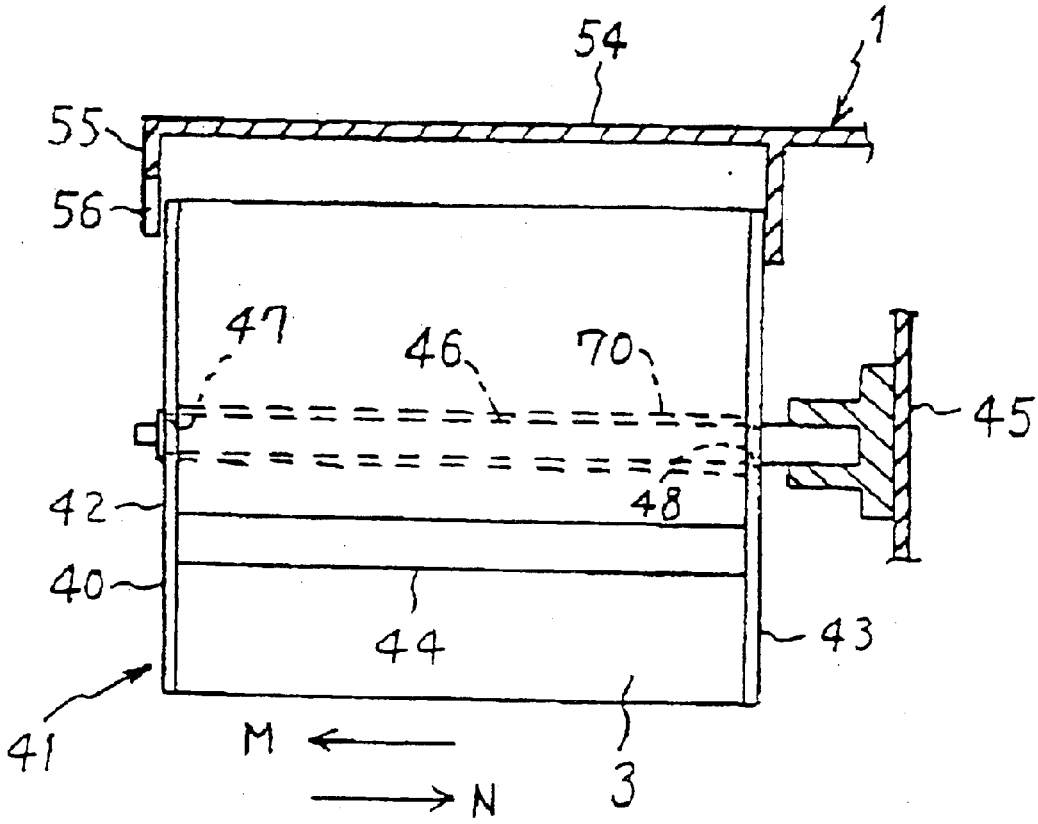
FIG. 8 is a sectional side elevation showing the belt unit set in the casing of the image forming apparatus.

As shown in FIGS. 6 and 8, the belt 3 is constructed into a belt unit 41 together with a frame 40 supporting the belt 3. The frame 40 is made up of a front side wall 42, a rear side wall 43, and a plurality of tie bars 44 (only one is shown in FIG. 8) connecting the side walls 42 and 43. The rollers 4, 5 and 24 supporting the belt 3 are rotatably mounted on the side walls 42 and 43. Further, the first image transferring devices 13Y through 13Y, second image transferring devices 13YA through 13BKA and heat pipes 34 shown in FIG. 1 are rotatably mounted on the side walls 42 and 43. In addition, the case 32 of the cleaning device 29 and third image transferring device 14 are mounted on the frame 40.

As shown in FIG. 8, the support shaft 46 is affixed at one end to a rear wall 45 included in the casing 1 and extends horizontally toward the front end of the casing 1. The front end of the support shaft 46 is free, so that the support shaft 46 is cantilevered by the casing 1. The support shaft 46 extends through holes 47 and 48 formed in the side walls 42 and 43, respectively. Therefore, as shown in FIGS. 1 and 9, the support shaft 46 supports the entire belt unit 41 such that the belt unit 41 is angularly movable about the support shaft 46. The support shaft 46 is positioned between the opposite runs of the belt 3.

As shown in FIG. 8, a guide tube 70 may be affixed to the side walls 42 and 43 of the frame 40 coaxially with the holes 47 and 48, in which case the support shaft 46 will be passed through the guide tube 70.

As stated above, the belt unit 41 is angularly movable about the support shaft 46, causing the belt 3 to move between the first position and the second position stated earlier. The operator can therefore easily, stably move the belt 3 away from the first and second drums substantially at the same time. At this instant, the movable range of the belt unit 41 is limited such that when the belt 3 is brought to the second position shown in FIG. 9, the belt unit 41 does not interfere with members constituting the conveyance paths. More specifically, the belt 3 at the second position adjoins, e.g., the registration roller pair 18, but does not interfere with it or damage it. Moreover, the belt unit 41 can be easily moved to locate the belt 3 at the second position because the first drums 2Y through 2BK are positioned below the intermediate between the top and the bottom of the belt 3 and because the second drums 2YA through 2BKA are positioned above the same, as sated earlier.

A locking device, not shown, should preferably be used to hold the belt 3 stably at the first position by inhibiting the movement of the belt unit 41. By opening the front door 37 and unlocking the locking device, the operator can freely move the belt unit 41 to the second position by hand.

The belt unit 41 is mounted on the support shaft 46 in such a manner as to be slidable in the axial direction of the shaft 46. This allows the operator to remove the belt unit 41 from the casing 1 by opening the front door 37, moving the belt unit 41 from the first position to the second position, and then pulling out the belt unit 41 toward the operator along the support shaft 46, as indicated by an arrow M in FIG. 8. To mount the belt unit 41 to the casing 1, the operator performs the above procedure in the reverse order; the belt unit 41 is pushed into the casing 1 in a direction indicated by an arrow N.

In the illustrative embodiment, the first and second image forming units 11 and 11A, like the belt unit 41, can be mounted and dismounted from the casing 1 at the front of the casing 1. More specifically, as shown in FIGS. 1, 6, 7 and 9, a fist and a second guide stay 52 and 52A, respectively, are disposed in the casing 1 and extend from the rear toward the front of the casing 1. The unit cases 10 and 10A of the image forming units 11 and 11A are respectively supported by the guide stays 52 and 52A in such a manner as to be slidable in the front-and-rear direction of the casing 1. To dismount the image forming units 11 and 11A from the casing 1, the operator opens the front door 37, moves the belt unit 41 to the second position shown in FIGS. 7 and 9, and then pulls the image forming units 11 and 11A toward the operator one by one. To mount the image forming units 11 and 11A to the casing 1, the operator performs the above procedure in the reverse order.

A locking device should preferably be provided for locking the image forming units 11 and 11A at preselected positions inside the casing 1, in which case the operator will operate the locking device to unlock the image forming units 11 and 11A before pulling them out.

In any case, the operator can pull out the image forming units 11 and 11A and then replace them with new ones or replace only the process units PU and PUA by removing them from the unit cases 10 and 10A. In this manner, the image forming units 11 and 11A and belt unit 41 can be pulled out via the front end of the casing 1. Should such units be configured to be pulled out of the casing 1 sideways, peripheral units around the casing 1 would have to be positioned below the casing 1, further increasing the overall height of the apparatus.

The optical writing units 12 and 12A assigned to the process units PU and PUA, respectively, are implemented as members separate from the first and second image forming units 11 and 11A, as stated earlier. This is because the writing units 12 and 12A are generally longer in service life than the drums and the other process units; if the writing units 12 and 12A are included in the image forming units 11 and 11A and replaced together, then the writing units 12 and 12A are simply wasted despite that they are still usable.

The writing units 12 and 12A can be removed from the casing 1 alone when they should be replaced or cleaned. Also, the image forming units 11 and 11A can be removed from the casing 1 while leaving the writing units 12 and 12A in the casing 1. That is, the writing units 12 and 12A are removably mounted on the casing 1 independently of the image forming units 11 and 11A.

Figure 7:
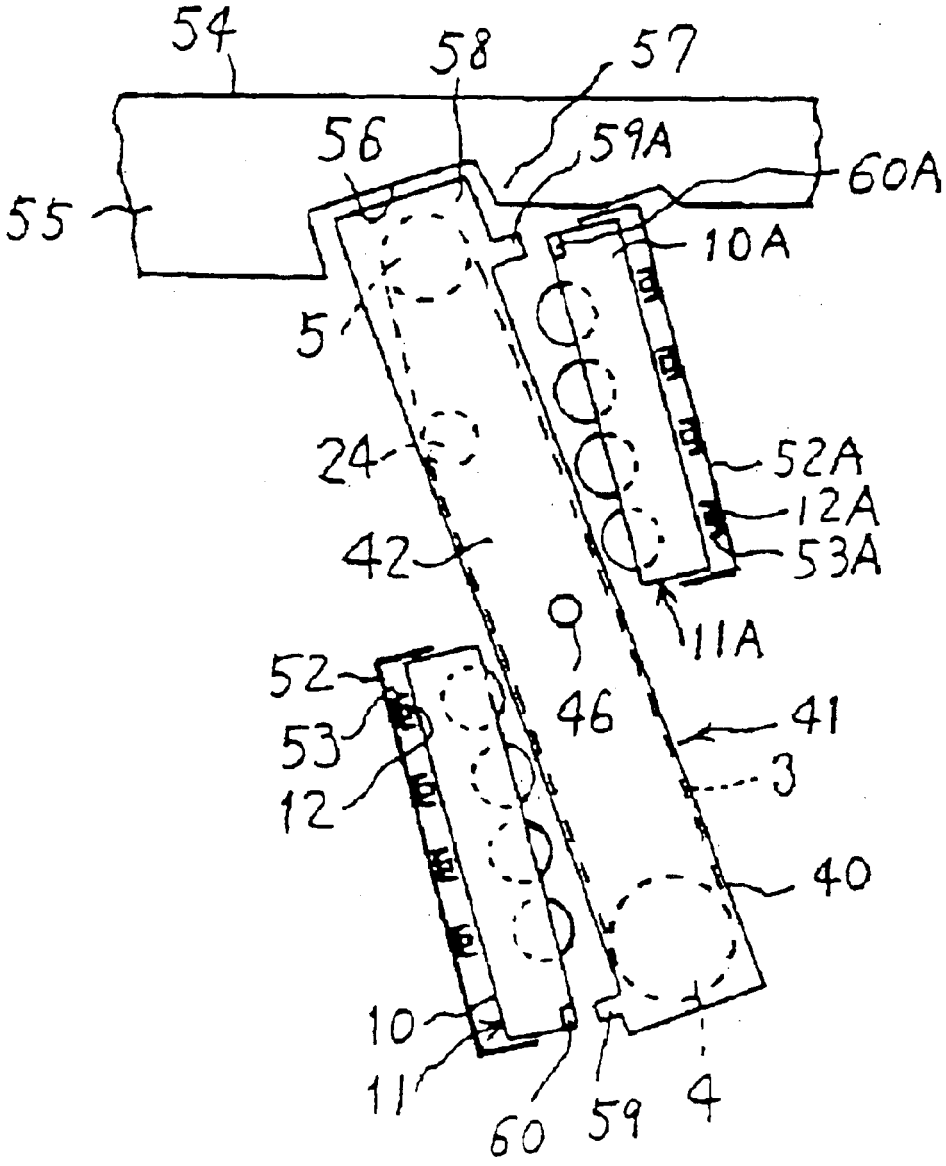
FIG. 7 is a front view showing a belt unit angularly moved from the position shown in FIG. 6.

More specifically, as shown in FIGS. 7 and 9, a first and a second guide rail 53 and 53A, respectively, are respectively affixed to the first and second guide stays 52 and 52A in correspondence to the writing units 12 and 12A. The guide rails 53 and 53A extend in the front-and-rear direction of the casing 1, i.e., substantially in parallel to the support shaft 46, and guide the writing units 12 and 12A, respectively. The operator can therefore pull out the writing units 12 and 12A toward the operator along the guide rails 53 and 53A or push them into the casing 1 along the guide rails 53 and 53A.

The writing units 12 and 12A may be implemented as laser units for scanning the associated drums in the main scanning direction with laser beams in accordance with image data. In the illustrative embodiment, the writing units 12 and 12A are implemented as light source arrays, e.g., LED (Light Emitting Diode) arrays. Light beams issuing from the individual light sources are focused on the charged surface of the associated drum via lenses, not shown, forming a latent image thereon. This kind of writing unit is disclosed in, e.g., Japanese Utility Model Publication No. 2-42454. The LED array, for example, is far smaller in size than a laser unit and therefore occupies a minimum of space in the casing 1, thereby reducing the size of the casing 1.

The belt unit 41 is supported such that it can be pulled out of the casing 1 toward the front, as stated previously. The operator may inadvertently pull the belt unit 41 held in the first position, i.e., held in contact with the first and second drums toward the operator. This would cause the belt 3 and first and second drums to rub and scratch each other. In light of this, the illustrative embodiment includes belt unit checking means for inhibiting, when the belt 3 is held in the first position, the belt unit 41 from being pulled out of the casing 1.

The first and second image forming units 11 and 11A are also supported such that they can be pulled out of the casing 1 toward the front, as stated previously. The operator may inadvertently pull any one of the image forming units 11 and 11A held in contact with the belt 3 toward the operator. This would cause the first and second drums and belt 3 to rub and scratch each other. In light of this, the illustrative embodiment includes image forming unit checking means for inhibiting, when the belt 3 is held in the first position, the image forming units 11 and 11A from being pulled out of the casing 1.

More specifically, as shown in FIGS. 6, 7 and 8, the casing 1 includes a cover 54 that, in turn, includes a front portion 55. The front portion 55 is formed with a notch 56 for allowing the belt unit 41 to pass when the belt unit 41 is mounted to or dismounted from the casing 1. As shown in FIG. 6, when the belt 3 is held in contact with the first and second drums at the first position, the belt unit 41 is located at a position deeper than the front portion 55 of the cover 55. In this condition, part 58 of the frame 40 included in the belt unit 41 overlaps a stop 57 formed by part of the front portion 55 adjoining the notch 56, as seen from the front of the casing 1. Therefore, so long as the belt 3 is held in the first position, the operator cannot pull out the belt unit 41 toward the front because the stop 57 checks the part 58 of the frame 40.

When the operator moves the belt unit 41 to the position shown in FIG. 7 so as to move the belt 3 to the second position spaced from the first and second drums, the frame 40 of the belt unit 41 is shifted to a position where it does not interfere with the stop 57. In this condition, the operator can pull the belt unit 41 toward the front out of the casing 1. The stop 57 may, of course, be implemented by a member other than the cover 55 or may even be implemented as an independent stop affixed to the casing 1.

As for the image forming unit checking means, as shown in FIGS. 6 and 7, the frame 40 of the belt unit 41 is formed with a first lug 59 and a second lug 59A while the cases 10 and 10A of the first and second image forming units 11 and 11A are formed with a first recess 60 and a second recess 60A, respectively. As shown in FIG. 6, when the stop 57 checks the belt unit 41 with the belt 3 remaining at the first position, the lugs 59 and 59A respectively mate with the recesses 60 and 60A for thereby preventing the image forming units 11 and 11A from being pulled toward the front of the casing 1 away from the belt unit 41. This prevents the operator from pulling out the image forming units 11 and 11A out of the casing 1.

When the operator moves the belt unit 41 so as to bring the belt 3 to the second position released from the first and second drums, the lugs 59 and 59A of the belt unit 41 are released from the recesses 60 and 60A of the image forming units 11 and 11A. In this condition, the operator can pull the image forming units 11 and 11A out of the casing 1.

The lugs 59 and 59A of the belt unit 41 and the recesses 60 and 60A of the image forming units 11 and 11A may, of course, replaced with each other so long as they can constitute locking portions.

Figure 10:
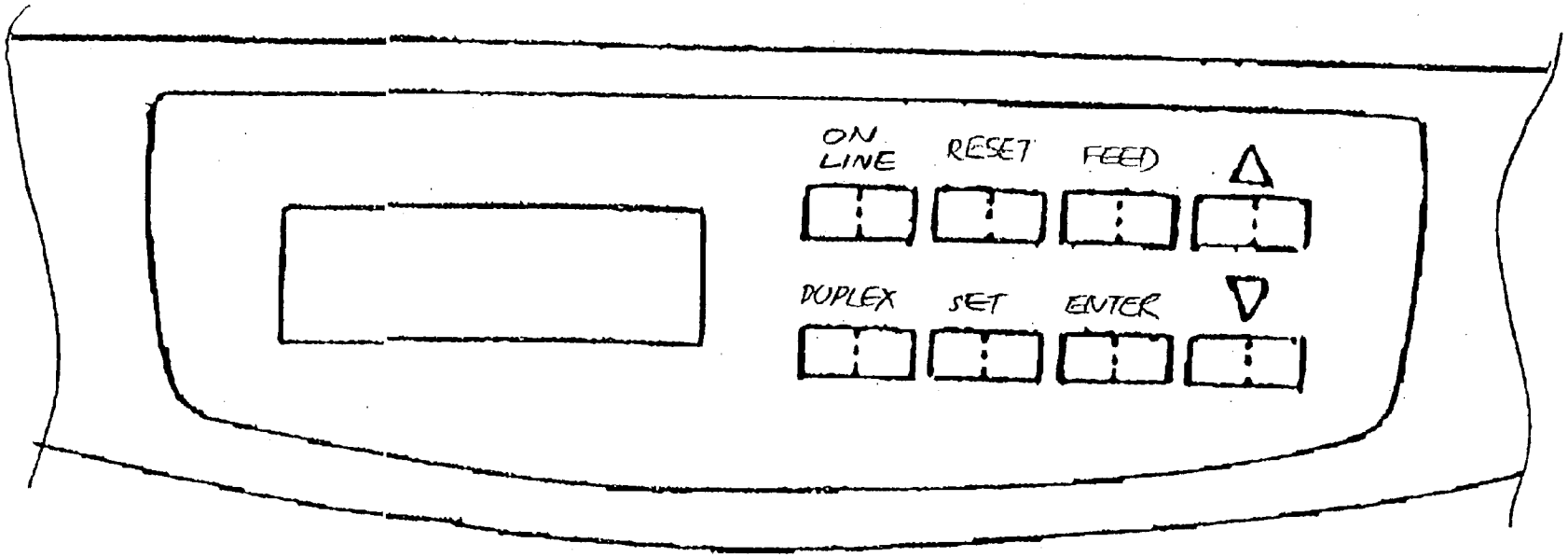
FIG. 10 is an fragmentary enlarged view showing a specific configuration of an operation panel included in the illustrative embodiment.

Referring again to FIG. 1, the image forming apparatus described above may be connected to a host computer or similar host 61 to thereby construct an image forming system. In this case, the operator inputs, e.g., desired image forming conditions on the host computer 61 or an operation panel 51 mounted on the casing 1. FIG. 10 shows a specific configuration of part of the operation panel 51 including various keys and a display. The operator may select a duplex print mode by pressing a duplex key on the operation panel 51, select special sheets by pressing a sheet feed button, and select a sheet feeder by pressing a set button, as desired. Alternatively, the operator may cause the host computer 61 to show a detailed picture on its display and then input desired process conditions for image formation based on the image. To transfer the characteristics of a recording medium, the operator may input them on the operation panel 51 or on the keyboard while watching a picture on the host computer 61. Alternatively, a particular switch may be assigned to each sheet feeder, in which case the operator will operated any one of such switches matching with the kind of recording medium. Further, an exclusive tray for, e.g., envelopes or postcards may be prepared and removably mounted to the casing 1, so that the apparatus can identify the exclusive tray. In any case, the apparatus can print information to be dealt with by the host computer 61 in accordance with the object and the kind of recording medium.

In the specific system in which the image forming apparatus and host computer 61 are interconnected by a network, the apparatus mainly plays the role of an output terminal (printer) or a facsimile apparatus for the host computer 61. A scanner, not shown, may be connected to the apparatus so as to construct a copy system. Of course, the apparatus and host computer 61, for example, may communicate with each other by radio.

Images can be printed on both sides of the webbing paid out from the roll RP, as stated earlier. The operator may therefore paginate on the host computer 61 and cause the webbing to be folded, stapled cut or otherwise finished to produce, e.g., a booklet.

Further, the operating conditions of the image forming apparatus, the remaining amounts of supplies and so forth may be displayed on the host computer 61.

While the illustrative embodiment has concentrated on a printer, the present invention is similarly applicable to any other image forming apparatus, e.g., an electronic copier or facsimile apparatus or a multifunction machine or even to an image forming system including the image forming apparatus.

In summary, it will be seen that the present invention provides an image forming apparatus having a minimum of height despite that it includes a plurality of sheet feeders, while preserving the merits of an intermediate image transfer belt extending in the up-and-down direction.

Various modifications will become possible for those skilled in the art after receiving the teachings of the present disclosure without departing from the scope thereof.

What is claimed is:

1. An image forming apparatus comprising:

at least one first image carrier on which an image is to be formed;

an endless, intermediate image transfer belt to which the image is to be transferred from said first image carrier; and at least one second image carrier on which an image is to be formed;

wherein said first and second image carriers and said intermediate image transfer belt are arranged such that the image formed on said second image carrier is directly transferred to a first side of a recording medium while the image transferred to said intermediate image transfer belt is transferred to a second side of said recording medium, said intermediate image transfer belt is elongate in an up-and-down direction, and a plurality of medium feeders are arranged one above the other at one side of said intermediate image transfer belt, and each is loaded with a stack of recording media to be fed toward an image transfer position.

2. The apparatus as claimed in claim 1, wherein in a simplex print mode the image on said second image carrier is transferred to the one side of the recording medium while no images are transferred to the second side of said recording medium.

3. The apparatus as claimed in claim 2, wherein said intermediate image transfer belt is inclined from a vertical direction, said first image carrier and said second image carrier are respectively positioned at opposite sides of said intermediate image transfer belt, and said second image carrier is positioned between said intermediate image transfer belt and said plurality of medium feeders.

4. The apparatus as claimed in claim 3, wherein at least one of said plurality of medium feeders comprises a roll feeder for paying out the recording medium implemented as a roll.

5. The apparatus as claimed in claim 4, wherein a position where the recording medium is to be paid out from the roll is positioned above a center of said roll.

6. The apparatus as claimed in claim 5, wherein a print tray is positioned above said plurality of medium feeders for receiving the recording medium undergone image formation.

7. The apparatus as claimed in claim 6, wherein a conveyance path extending from said plurality of medium feeders to said print tray is configured such that the recording medium is driven out to said print tray with the image transferred from said second image carrier facing downward.

8. The apparatus as claimed in claim 7, wherein said print tray is openable while a top one of said plurality of medium feeders is implemented as the roll feeder, whereby the roll can be mounted or dismounted by opening said print tray.

9. The apparatus as claimed in claim 8, wherein at least one of said plurality of medium feeders comprises a manual medium feeder.

10. The apparatus as claimed in claim 9, further comprising a registering device positioned below said second image carrier for conveying the recording medium fed from any one of said plurality of medium feeders toward the image transfer position at a preselected timing, wherein a conveyance path extending from said manual medium feeder to said registering device is substantially linear.

11. The apparatus as claimed in claim 10, wherein said second image carrier is positioned above an intermediate of said intermediate image transfer belt in the up-and-down direction while said registering device is positioned below said second image carrier.

12. The apparatus as claimed in claim 11, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

13. The apparatus as claimed in claim 12, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said, intermediate image transfer belt is spaced from said first image carrier and said second image carrier, and an angularly movable range of said belt unit is selected such that when said intermediate image transfer belt is held in said second position, said belt unit does not interfere with members forming the conveyance path.

14. The apparatus as claimed in claim 13, wherein said first image carrier is position below the intermediate of said intermediate image transfer belt while said second image carrier is positioned above said intermediate of said intermediate image transfer belt.

15. The apparatus as claimed in claim 14, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

16. The apparatus as claimed in claim 1, wherein said intermediate image transfer belt is inclined from a vertical direction, said first image carrier and said second image carrier are respectively positioned at opposite sides of said intermediate image transfer belt, and said second image carrier is positioned between said intermediate image transfer belt and said plurality of medium feeders.

17. The apparatus as claimed in claim 16, wherein at least one of said plurality of medium feeders comprises a roll feeder for paying out the recording medium implemented as a roll.

18. The apparatus as claimed in claim 17, wherein a position where the recording medium is to be paid out from the roll is positioned above a center of said roll.

19. The apparatus as claimed in claim 18, wherein a print tray is positioned above said plurality of medium feeders for receiving the recording medium undergone image formation.

20. The apparatus as claimed in claim 19, wherein a conveyance path extending from said plurality of medium feeders to said print tray is configured such that the recording medium is driven out to said print tray with the image transferred from said second image carrier facing downward.

21. The apparatus as claimed in claim 20, wherein said print tray is openable while a top one of said plurality of medium feeders is implemented as the roll feeder, whereby the roll can be mounted or dismounted by opening said print tray.

22. The apparatus as claimed in claim 21, wherein at least one of said plurality of medium feeders comprises a manual medium feeder.

23. The apparatus as claimed in claim 22, further comprising a registering device positioned below said second image carrier for conveying the recording medium fed from any one of said plurality of medium feeders toward the image transfer position at a preselected timing, wherein a conveyance path extending from said manual medium feeder to said registering device is substantially linear.

24. The apparatus as claimed in claim 23, wherein said second image carrier is positioned above an intermediate of said intermediate image transfer belt in the up-and-down direction while said registering device is positioned below said second image carrier.

25. The apparatus as claimed in claim 24, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

26. The apparatus as claimed in claim 25, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

27. The apparatus as claimed in claim 26, wherein said first image carrier is position below the intermediate of said intermediate image transfer belt while said second image carrier is positioned above said intermediate of said intermediate image transfer belt.

28. The apparatus as claimed in claim 27, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

29. The apparatus as claimed in claim 1, wherein at least one of said plurality of medium feeders comprises a roll feeder for paying out the recording medium implemented as a roll.

30. The apparatus as claimed in claim 29, wherein a position where the recording medium is to be paid out from the roll is positioned above a center of said roll.

31. The apparatus as claimed in claim 30, wherein a print tray is positioned above said plurality of medium feeders for receiving the recording medium undergone image formation.

32. The apparatus as claimed in claim 31, wherein a conveyance path extending from said plurality of medium feeders to said print tray is configured such that the recording medium is driven out to said print tray with the image transferred from said second image carrier facing downward.

33. The apparatus as claimed in claim 32, wherein said print tray is openable while a top one of said plurality of medium feeders is implemented as the roll feeder, whereby the roll can be mounted or dismounted by opening said print tray.

34. The apparatus as claimed in claim 33, wherein at least one of said plurality of medium feeders comprises a manual medium feeder.

35. The apparatus as claimed in claim 34, further comprising a registering device positioned below said second image carrier for conveying the recording medium fed from any one of said plurality of medium feeders toward the image transfer position at a preselected timing, wherein a conveyance path extending from said manual medium feeder to said registering device is substantially linear.

36. The apparatus as claimed in claim 35, wherein said second image carrier is positioned above an intermediate of said intermediate image transfer belt in the up-and-down direction while said registering device is positioned below said second image carrier.

37. The apparatus as claimed in claim 36, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

38. The apparatus as claimed in claim 37, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

39. The apparatus as claimed in claim 38, wherein said first image carrier is position below the intermediate of said intermediate image transfer belt while said second image carrier is positioned above said intermediate of said intermediate image transfer belt.

40. The apparatus as claimed in claim 39, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

41. The apparatus as claimed in claim 1, wherein a print tray is positioned above said plurality of medium feeders for receiving the recording medium undergone image formation.

42. The apparatus as claimed in claim 41, wherein a conveyance path extending from said plurality of medium feeders to said print tray is configured such that the recording medium is driven out to said print tray with the image transferred from said second image carrier facing downward.

43. The apparatus as claimed in claim 42, wherein said print tray is openable while a top one of said plurality of medium feeders is implemented as a roll feeder, whereby the roll can be mounted or dismounted by opening said print tray.

44. The apparatus as claimed in claim 43, wherein at least one of said plurality of medium feeders comprises a manual medium feeder.

45. The apparatus as claimed in claim 44, further comprising a registering device positioned below said second image carrier for conveying the recording medium fed from any one of said plurality of medium feeders toward the image transfer position at a preselected timing, wherein a conveyance path extending from said manual medium feeder to said registering device is substantially linear.

46. The apparatus as claimed in claim 45, wherein said second image carrier is positioned above an intermediate of said intermediate image transfer belt in the up-and-down direction while said registering device is positioned below said second image carrier.

47. The apparatus as claimed in claim 46, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

48. The apparatus as claimed in claim 47, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

49. The apparatus as claimed in claim 48, wherein said first image carrier is position below the intermediate of said intermediate image transfer belt while said second image carrier is positioned above said intermediate of said intermediate image transfer belt.

50. The apparatus as claimed in claim 49, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

51. The apparatus as claimed in claim 1, wherein at least one of said plurality of medium feeders comprises a manual medium feeder.

52. The apparatus as claimed in claim 51, further comprising a registering device positioned below said second image carrier for conveying the recording medium fed from any one of said plurality of medium feeders toward the image transfer position at a preselected timing, wherein a conveyance path extending from said manual medium feeder to said registering device is substantially linear.

53. The apparatus as claimed in claim 52, wherein said second image carrier is positioned above an intermediate of said intermediate image transfer belt in the up-and-down direction while said registering device is positioned below said second image carrier.

54. The apparatus as claimed in claim 53, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

55. The apparatus as claimed in claim 54, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

56. The apparatus as claimed in claim 55, wherein said first image carrier is position below the intermediate of said intermediate image transfer belt while said second image carrier is positioned above said intermediate of said intermediate image transfer belt.

57. The apparatus as claimed in claim 56, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

58. The apparatus as claimed in claim 1, wherein said second image carrier is positioned above an intermediate of said intermediate image transfer belt in the up-and-down direction while a registering device is positioned below said second image carrier.

59. The apparatus as claimed in claim 58, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

60. The apparatus as claimed in claim 59, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

61. The apparatus as claimed in claim 60, wherein said first image carrier is position below the intermediate of said intermediate image transfer belt while said second image carrier is positioned above said intermediate of said intermediate image transfer belt.

62. The apparatus as claimed in claim 61, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

63. The apparatus as claimed in claim 1, wherein said first image carrier is positioned below the intermediate of said intermediate image transfer belt, and at least one of a cleaning device is positioned above said first image carrier for cleaning a surface of said intermediate image transfer belt after image transfer and a cooling device for cooling off said intermediate image transfer belt is positioned above said first image carrier.

64. The apparatus as claimed in claim 63, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

65. The apparatus as claimed in claim 64, wherein said first image carrier is position below the intermediate of said intermediate image transfer belt while said second image carrier is positioned above said intermediate of said intermediate image transfer belt.

66. The apparatus as claimed in claim 65, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

67. The apparatus as claimed in claim 1, wherein at least said intermediate image transfer belt and a frame supporting said intermediate image transfer belt are constructed into a single belt unit, said belt unit is supported such that said belt unit is angularly movable to move said intermediate image transfer belt between a first position where said belt contacts said first image carrier and said second image carrier and a second position where said intermediate image transfer belt is spaced from said first image carrier and said second image carrier, and an angularly movable range of said belt unit is selected such that when said intermediate image transfer belt is held in said second position, said belt unit does not interfere with members forming the conveyance path.

68. The apparatus as claimed in claim 67, wherein said first image carrier is position below a mid-portion of said intermediate image transfer belt while said second image carrier is positioned above the mid-portion of said intermediate image transfer belt.

69. The apparatus as claimed in claim 68, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

70. The apparatus as claimed in claim 1, wherein said first image carrier comprises a plurality of first image carriers arranged along said intermediate image transfer belt each for forming an image in a particular color, and said second image carrier comprises a plurality of second image carriers arranged along said intermediate image transfer belt each for forming an image in a particular color.

71. In an image forming system comprising an image forming apparatus and a host interconnected to each other, said image forming apparatus comprising:

at least one first image carrier on which an image is to be formed;

an endless, intermediate image transfer belt to which the image is to be transferred from said first image carrier; and at least one second image carrier on which an image is to be formed;

wherein said first and second image carriers and said intermediate image transfer belt are arranged such that the image formed on said second image carrier is directly transferred to a first side of a recording medium while the image transferred to said intermediate image transfer belt is transferred to a second side of said recording medium, said intermediate, image transfer belt is elongate in an up-and-down direction, and a plurality of medium feeders are arranged one above the other at one side of said intermediate image transfer belt, and each is loaded with a stack of recording media to be fed toward an image transfer position.

* * * * *